US007558377B2

(12) United States Patent
Freudenberger et al.

(10) Patent No.: US 7,558,377 B2
(45) Date of Patent: Jul. 7, 2009

(54) X-RAY ANODE

(75) Inventors: Joerg Freudenberger, Eckental (DE); Eberhard Lenz, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/840,303

(22) Filed: Aug. 17, 2007

(65) Prior Publication Data

US 2008/0043921 A1 Feb. 21, 2008

(30) Foreign Application Priority Data

Aug. 17, 2006 (DE) ..... 10 2006 038 417

(51) Int. Cl.
*H01J 35/08* (2006.01)

(52) U.S. Cl. ..... 378/143; 378/144

(58) Field of Classification Search ..... 378/119, 378/121, 122, 125–130, 143, 144
See application file for complete search history.

(56) References Cited

U.S. PATENT DOCUMENTS

| | | | | |
|---|---|---|---|---|
| 5,825,848 | A | 10/1998 | Virshup et al. | |
| 6,554,179 | B2 * | 4/2003 | Horner et al. | 228/122.1 |
| 7,194,066 | B2 | 3/2007 | Tiearney, Jr. et al. | |
| 7,197,119 | B2 | 3/2007 | Freudenberger et al. | |
| 7,250,208 | B2 * | 7/2007 | Lenz | 428/292.1 |
| 2004/0013234 | A1 * | 1/2004 | Kutschera | 378/144 |
| 2004/0191495 | A1 | 9/2004 | Lenz | |
| 2007/0195934 | A1 * | 8/2007 | Weiss et al. | 378/144 |

* cited by examiner

*Primary Examiner*—Jurie Yun
(74) *Attorney, Agent, or Firm*—Schiff Hardin LLP

(57) ABSTRACT

An x-ray anode has an emission layer and a carrier with carrier material to support the emission layer. The carrier material is a metallized carbon fiber material with a portion in which the fibers are specifically directed. A high heat dissipation from the emission layer and a coefficient of heat expansion of the carrier that is advantageous for bonding with the emission layer are achieved.

11 Claims, 1 Drawing Sheet

X-RAY ANODE

BACKGROUND OF THE INVENTION

1. Field of the Invention

The present invention concerns an x-ray anode of the type having an emission layer and a carrier with carrier material to support the emission layer.

2. Description of the Prior Art

X-ray tubes include an x-ray anode and a cathode that are arranged in a vacuum enclosure. Electrons are thermally liberated from the cathode and accelerated by high voltage toward the anode where they are decelerated in an emission layer and generate x-rays. A large portion of the kinetic energy of the electrons is converted into heat that severely heats the x-ray anode during its operation. The power capacity of x-ray tubes is limited by this thermal loading of the x-ray anode. Various designs are known to increase the thermal capacity. For x-ray anodes executed as fixed (stationary) anodes, it is known to conduct heat from the x-ray anode via intermediate structures into a heat storage (heat accumulator or heat reservoir) made, for example, from graphite. For x-ray anodes executed as rotary anodes, the electron beam is directed onto a point on the surface of the plate-shaped x-ray anode at a distance R from the center point. By a fast rotation of the x-ray anode in operation, the heat is distributed along the focal ring described by the point and can additionally distribute during a rotation of the x-ray anode before the point is struck again by the electron beam. Cooling of the rotary anode with coolant is additionally known. A significantly higher capacity can be achieved than with fixed anodes. For rotary piston radiators it is known to rotate the entire x-ray tube in a bath of coolant and to thereby dissipate the heat from the x-ray anode.

It is common to all forms of x-ray anodes that the heat must be dissipated from the emission layer and conducted into a heat storage or a coolant. A carrier for supporting of the emission layer that is executed as an intermediate layer or directly as a heat storage, serves for this purpose. The emission layer is directly or indirectly applied.

From DE 10 2004 003 370 A1 it is known to produce this carrier from a combination made of a copper alloy for heat dissipation and a molybdenum alloy to impart the necessary stability. A very good heat dissipation can be achieved for highly heat-conductive graphite, but the problem exists that the coefficient of heat expansion of the graphite is not adapted to that of the emission layer. This leads to the situation that given a high loading of the x-ray anode small tears (fissures) arise due to the different expansion of the emission layer and the heat conductor. Such tears lead to a destruction of the x-ray anode.

To solve this problem it is known from DE 10 2005 015 920 A1 to insert a carrier made from one or more intermediate layers of carbon fiber material between the heat conductor (made from a carbon substance) and the emission layer, the carrier being backed with high melting point (refractory) metals. By varying the quantity of carbon fibers to metal, the coefficient of heat expansion can be adjusted in a certain range and thus a more densely stepped gradient of the coefficient of heat expansion can be achieved over a number of intermediate layers of the carrier. In this very stable solution, however, the heat conductivity of the carrier is unsatisfactory in a high capacity range of the x-ray anode.

SUMMARY OF THE INVENTION

An object of the invention to specify an x-ray anode that combines a high capacity for heat dissipation with a coefficient of heat expansion suitable for connection with the emission layer.

This object is achieved in accordance with the invention by an x-ray anode of the aforementioned type in which the carrier material is a metallized carbon fiber material with a portion in which the fibers are specifically directed. A high heat conductivity in the longitudinal direction and an adapted coefficient of heat expansion in the radial direction of the carbon fibers is achieved by the fiber alignment.

The invention is based on the insight that carbon fibers exhibit a significantly higher heat conductivity in the longitudinal direction than in the radial direction. By arranging the carbon fibers in a desired heat conduction direction, a significantly higher heat conduction can be achieved in this direction than with undirected carbon fibers. Moreover, the invention is based on the further consideration that carbon fibers exhibit a significantly smaller coefficient of heat expansion in the longitudinal direction than in the radial direction. By corresponding inclination of the carbon fibers in the carrier material relative to a rotation axis of the x-ray anode, a coefficient of heat expansion of the carrier material thus can be varied and be set to a desired value. A thermo-mechanical adaptation of the carrier material to the emission layer can be achieved and tear formation can be avoided. A long lifespan in combination with a high mechanical stability of the x-ray anode is achieved. The x-ray anode can be operated with a high rotation speed of, for example, 15,000 revolutions/min without having to forego a high conductivity.

The x-ray anode can be an arbitrary x-ray anode such as a fixed anode, a rotary anode or an anode in a rotary piston radiator. The carbon fiber material can have one or more directed portions. In the directed portion at least a predominant part of the carbon fibers exhibits a provided preferred direction. The preferred direction can be set according to a functional dependence on the location within the carrier. The preferred direction corresponds to the longitudinal direction of the carbon fibers. The directed portions in combination form the predominant part of all carbon fibers in the carrier material, in particular over 90% of all carbon fibers. The average length of the carbon fibers is advantageously greater than 1 mm in order to make an alignment easier. As used herein "Carbon fibers" means all fibers with a carbon content over 90%, advantageously over 95% for graphite fibers. By the metallization the carbon fibers are provided with the metal directly or by one or more bonding layers around the fibers (for example made from a carbide creator). The carbon fibers are advantageously wetted by the metal.

In an embodiment of the invention the directed portion is aligned toward the emission layer. A high heat dissipation away from the emission layer in the longitudinal direction of the carbon fibers can be achieved by the alignment of the carbon fibers of the directed portion relative to the emission layer, making use of the high heat conductivity of the carbon fibers in their longitudinal direction. A heat conductivity of the carrier material can be achieved that is greater than that of a highly heat-conductive metal (for example copper). The directed portion is appropriately directed parallel to the rotation axis, so a good heat dissipation can be achieved in a rotary anode and in an anode of a rotary piston radiator.

The metallization of the carbon fiber material can be achieved in a simple manner when the carbon fiber material is impregnated (saturated) with metal. Moreover, the metal can be distributed particularly homogeneously in the carbon fiber material. A highly heat-conductive metal (for example copper or silver) as well as a highly heat-conductive metal alloy are suitable as a metal. Since carbon fibers can only be wetted with metal with difficulty, it is advantageous to add an additive metal that supports wetting (in particular cobalt or a carbide creator) to the highly heat-conductive metal or the metal alloy. It is likewise advantageous when the carbon fibers are externally provided with an activation layer, for example made from a metal carbide such as Mo, W and/or Cr carbide, or an etcher such as, for example, cobalt.

In a further embodiment of the invention the carbon fiber material is composed of at least one first carbon fiber type and a second carbon fiber type different from the first. A higher degree of freedom can be achieved in the adjustment of the coefficient of heat expansion in connection with a high heat conductivity and mechanical stability of the x-ray anode.

The first carbon fiber type is characterized by a higher heat conductivity relative to the second carbon fiber type, and the second carbon fiber type is characterized by a higher mechanical stability (and therewith a lower brittleness) relative to the first carbon fiber type. One task can be assigned to each type, so the tasks can be resolved substantially independently by the two carbon fiber types. The heat conductivity of the first carbon fiber type is appropriately at least 400 $Wm^{-1}K^{-1}$ in the fiber direction. The second carbon fiber type should have a high tensile strength and be less sensitive to brittleness and notching than the first carbon fiber type. It can be designed arbitrarily with regard to its heat conductivity.

The different properties of the carbon fibers in the longitudinal direction and in the radial direction can be utilized particularly well when the carbon fiber material exhibits two portions aligned in different preferred directions relative to one another. A predominant portion of each of the two carbon fiber types is appropriately aligned in a preferred direction and the preferred directions of the two portions are different from one another. Direction-related properties and type properties of the carbon fibers can be used separate from one another to adjust desired properties of the carrier material. The goal of achieving high stability is appropriately associated with one of the types and the goal to achieve the desired coefficient of heat expansion in the provided direction is assigned to the other type.

Due to the low coefficient of heat expansion in the longitudinal direction of the fibers in relation to the coefficient of heat expansion in the radial direction, the alignment of the carbon fibers of the coefficient of heat expansion of the carrier can be set in a direction-related manner via the alignment of the carbon fibers. Given a definition of an arbitrary reference direction, for example parallel to a rotation axis of the x-ray anode, a heat expansion of the carrier in the reference direction is smallest when the carbon fibers are aligned parallel to the reference direction. By an angling of the carbon fibers away from the parallel direction, the heat expansion in the reference direction becomes greater and greater the further that the carbon fibers are angled. If the carbon fibers are arranged tangential to the reference direction, the heat expansion in the reference direction is greatest.

A carrier with aligned carbon fibers whose alignment is tilted at a desired angle relative to a reference direction, for example relative to the rotation axis of the x-ray anode and (appropriately) additionally relative to a radial direction of the x-ray anode can be produced in a simple manner when the portion that is directed around the reference direction is arranged as a rolled mat. The mat thus can be arranged in tube form, for example along the radial outer periphery of the carrier, or appropriately exists radially in a rolled-up mat form from the inside outwards. After arranging the mat in this manner, it can be provided with metal, for example encapsulated (cast) with metal.

The x-ray anode exhibits a rotation axis, and the directed portion of the carbon fiber material is aligned in a helical track around the rotation axis. This arrangement can be produced particularly simply by the mat arrangement described above. The directed portion is advantageously at least predominantly formed from carbon fibers of the second carbon fiber type. For this purpose it is sufficient when a number of carbon fibers in combination form the helical track.

A high stability of the carrier can be achieved by a further directed portion, with the two directed portions being aligned in two helical tracks running counter to one another around the rotation axis. The carbon fibers of the two directed portions thus form a mesh.

In a further preferred embodiment of the invention the carrier has a first carbon fiber-containing layer lying nearest to the emission layer and a carbon fiber-containing layer further removed from the emission layer. The first layer contains a lesser proportion of carbon fiber than the second layer. In the first layer, to support a high heat conductivity, a least a portion of mechanically reinforced carbon fibers can be foregone in order to quickly dissipate as much heat as possible from the emission layer. For example, the first layer contains fewer carbon fibers of the second type than the second layer or no carbon fibers of the second type, but rather only carbon fibers of the first type aligned toward the emission layer.

A particularly resilient bonding of the carrier with the emission layer can be achieved when the carrier material is cast on the emission layer. The metal impregnating the carbon fiber material is preferably as a solder that bonds the carrier material with the emission layer, so the manufacturing can be kept simple. The soldering process can be simple and reliable due to an additive metal promoting the soldering process. For the intended wetting, it is particularly advantageous for the employed metal to chemically dissolve both in carbon and in the solder.

A thermally resilient and durable bonding of the carrier with the emission layer is achieved when the carrier material exhibits a coefficient of expansion adapted to the emission layer in the radial direction. Such an adaptation is realized when the coefficients of expansion of the emission layer and of the carrier material maximally differ by $1\times10^{-6}/°$ K in the radial direction.

DESCRIPTION OF THE PREFERRED EMBODIMENTS

Figure 1:
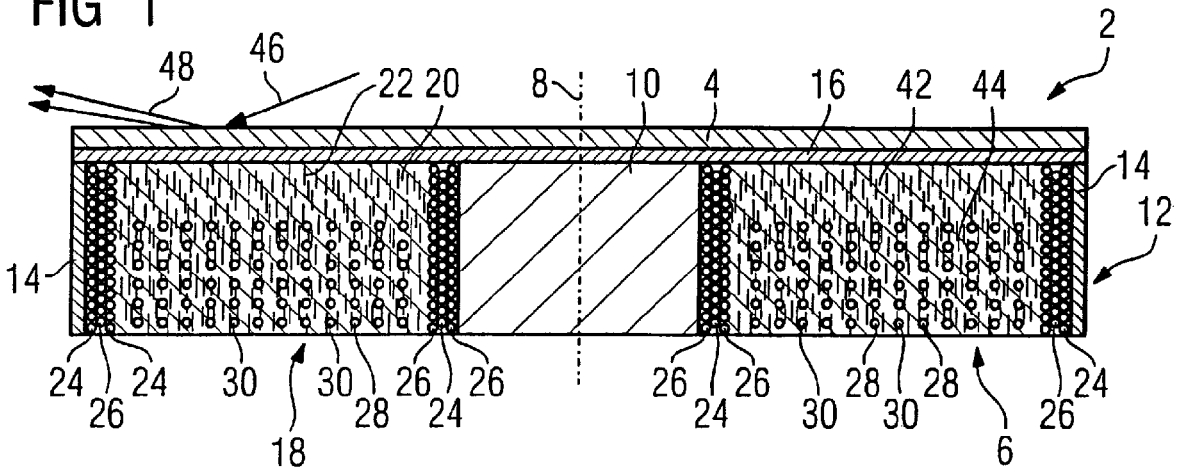
FIG. 1 is a section through an x-ray anode with an emission layer and a carrier containing a directed carbon fiber material.

FIG. 1 shows an x-ray anode 2 executed as a rotary anode that, for example, can be inside of a housing (not shown) of a rotating radiating tube. The rotary anode 2 has an emission layer 4 and a carrier 6 bearing the emission layer 4, which carrier 7 is thermally connected with a coolant circuit (not shown) and—like the emission layer 4—is rotationally symmetrical relative to a rotation axis 8. It have a cylindrical metallic core 10, a metallic housing 12 made from molybdenum with an outer wall 14 and an end wall 16 and a rotationally symmetrical ring 18 with a carrier material that is formed from a metallized carbon fiber material 20 with five directed portions 22, 24, 26, 28, 30. Each of the portions 22, 24, 26, 28, 30 comprises carbon fibers with an average length of 2 mm, of which over 95% are aligned in a predetermined preferred direction associated with the respective portion 22, 24, 26, 28, 30, with a deviation of at maximum ±5°. Essentially all carbon fibers of the carrier material are aligned in a predetermined, preferred direction in this manner.

The carbon fibers are divided into two carbon fiber types that differ in terms of their properties. The type 1 is characterized by a high heat conductivity in the axial direction. The type 2 shows a large coefficient of heat expansion in the radial direction and its carbon fibers are less sensitive to brittleness and scoring than the carbon fibers of the type 1. The heat conductivity of the type 2 in the axial direction is less than that of the type 1 and essentially plays no role. Some properties at room temperature are, in detail:

| | | Heat conductivity ($Wm^{-1}K^{-1}$) | Coefficient of heat expansion (ppm/K) |
|---|---|---|---|
| Type 1 | axial | 400 to 1900 | −1.0 to 0 |
| | radial | 5 to 40 | 5 to 20 |
| Type 2 | axial | 20 to 200 | −1.0 to 0 |
| | radial | 5 to 20 | 5 to 20 |

Figure 2:
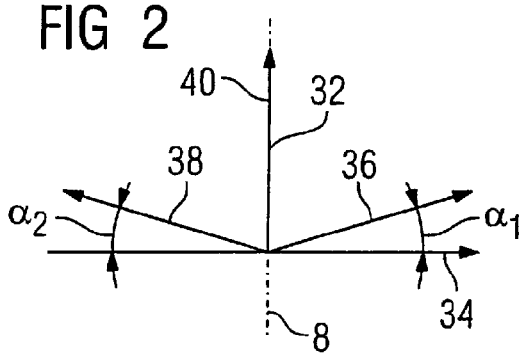
FIG. 2 is a diagram with preferred directions in which carbon fibers of the carbon fiber material are aligned.

The carbon fibers in the portion 22 are exclusively carbon fibers of the type 1 and are aligned parallel to the rotation axis 8 and thus towards the emission layer 3. The task to dissipate as much heat as possible from the emission layer 4 per unit of time is assigned to them. The carbon fibers of the portions 24, 26, 28, 30 are exclusively carbon fibers of the type 2 to which the task is assigned to ensure a desired coefficient of heat expansion in the radial direction 34 (FIG. 2). They are aligned helically around the rotation axis 8, the helical shape being accomplished by a number of carbon fibers arranged next to one another and after one another and not by individual carbon fibers alone. The carbon fibers of the portions 26 and 28 are arranged in the direction of a clockwise threading and the carbon fibers of the portions 24 and 30 are arranged in the direction of a counter-clockwise threading such that a meshwork of carbon fibers respectively results via the helical tracks of the portions 24, 26 and of the portions 28, 30 running opposite one another.

To explain the alignments, FIG. 2 schematically shows the axial direction 32 of the x-ray anode 2 that is parallel to the rotation axis 8, the tangential direction 34 around the rotation axis 8 (by which should also be understood the azimuthal direction within the x-ray anode 2) and two preferred directions 36, 38 that are applied as helical directions. The carbon fibers of the portions 26, 28 are arranged with a maximum deviation of ±5° in the preferred direction 36 that exhibits a helical angle $\alpha_1$ of 17° relative to the tangential direction 34 and is a clockwise helical direction. The carbon fibers of the portions 24, 30 are arranged with a maximum deviation of ±5° in the preferred direction 38 that exhibits a helical angle $\alpha_2$ of likewise 17° relative to the tangential direction 34 and is a counter-clockwise helical direction. The axial direction 32 corresponds to a third preferred direction 40 in which the carbon fibers of the portion 22 are likewise aligned with a maximum deviation of ±5°.

Due to the large difference of the coefficient of heat expansion of the carbon fibers of the type 2 in the axial and radial direction of the carbon fibers, the coefficient of heat expansion of the carrier material in the radial direction of the x-ray anode 2 can be adjusted within predetermined limits, dependent on the helical angles $\alpha_1$, $\alpha_2$ of the carbon fibers of the portions 24, 26, 28, 30, and be adapted to the coefficient of heat expansion of the emission layer 4 or another layer. The coefficient of heat expansion of the carrier material in the radial direction of the x-ray anode 2 is hereby additionally dependent on the quantity of the carbon fibers of the portions 22, 24, 26, 28, 30 relative to the quantity of the metal surrounding the carbon fibers. In the exemplary embodiment shown in FIG. 1, the carbon fibers occupy ⅔ of the volume and the metal ⅓ of the volume of the carrier material. The housing 12 is not designated as a carrier material. This volume ratio can be adjusted dependent on the requirements of the x-ray anode 2. A volume portion of 50% to 90% of the carbon fibers has proven to be advantageous.

To achieve a particularly good head dissipation from the emission layer 4, the carrier 6 is provided with a first carbon fiber-containing layer 42 situated next to the emission layer 4, under which first carbon fiber-containing layer 42 is arranged a second carbon fiber-containing layer 44 further removed from the emission layer 4, which second carbon fiber-containing layer 44 exhibits a higher carbon fiber proportion than the first layer 42. The carbon fibers of the type 2 imparting mechanical stability and setting the coefficient of heat expansion are reduced in the upper layer 42 so that the heat conductivity can ensue there undisturbed by the carbon fibers of the portion 22 and the metal.

During an x-ray operation electrons are accelerated from a cathode (not shown) onto the x-ray anode 2 and strike (as indicated by an arrow 46) in a radial outer region of the x-ray anode 2 on the emission layer 4. During this the x-ray anode 2 rotates with a frequency of 250 Hz around the rotation axis 8. By the rotation the electrons strike on a focal ring of the emission layer 4 that lies above the outer ring 18. In the focal ring x-ray radiation and a large amount of heat are generated by braking processes, which heat heats the emission layer 4. The heat is transferred through the thin end wall 16 to the carrier material of the outer ring 18 and is primarily conducted away from the emission layer 4 by the carbon fibers of the portion 22 that are parallel to the rotation axis 8. This emission layer 4 expands due to the heating of the emission layer 4. The carbon fibers of the portions 22, 24, 26, 28, 30 are thus selected in terms of quantity and arrangement such that the carrier material exhibits a coefficient of heat expansion adapted to the emission layer 4 in the radial direction, which coefficient of heat expansion is equal to that of the emission layer 4 in a range of $0.5\times0^{-6}/°$ K. The carbon fibers of the portions 24, 26 additionally provide for a mechanical stability that protects the x-ray anode 2 from out-of-balances even at high rotation speeds. Since the carbon fibers do not creep up to a temperature of 2200° C., a long-term stability is provided with regard to the geometry and an out-of-balance development is countered. The quantities of the carbon fibers of the portions 24, 26 relative to the portions 28, 30 can be varied depending on the requirement for heat expansion and mechanical stability.

To produce the x-ray anode 2, the core 10 is centered in the housing 12 so that an annular interstice is formed between core 10 and outer wall 14. A plurality of layers of carbon fiber material 20 in tissue or meshwork form are subsequently applied on the outer wall 14 and on the core 10, which layers form the portions 24, 26 and a part of the portion 22. The carbon fibers that form the portions 28, 30 and the further part of the portion 22 can then be placed inside in a loose meshwork. The carbon fibers can be inserted as tissue or meshwork mats in which the carbon fibers are already arranged in the desired preferred directions 36, 38, 40. A number of mats differing from one another are placed inside one another in alternation in order to form the meshwork with the helical tracks running opposite one another. To make wetting of the carbon fibers with metal easier, these are coated with Cr carbide, W carbide or Mo carbide or a combination of at least two of these carbides or with cobalt.

After completion of the meshwork, this is impregnated with a metal with very good heat conductivity, for example copper or silver. The metal now metalizing the current deflector 20 hereby serves as a solder to bond the carrier material with the end wall 16 of the housing 12 on which the emission layer 4 is applied. As an alternative or for further improvement of the wetting, the metal can be provided with a slight alloying of an additive metal that is a carbide creator and/or improves the bonding with the carbon fibers or the carbides and the soldering process with the end wall 16. To avoid voids (hollow spaces) in the carrier material, the carrier material is isostatically pressed with the liquid metal while hot.

Figure 3:
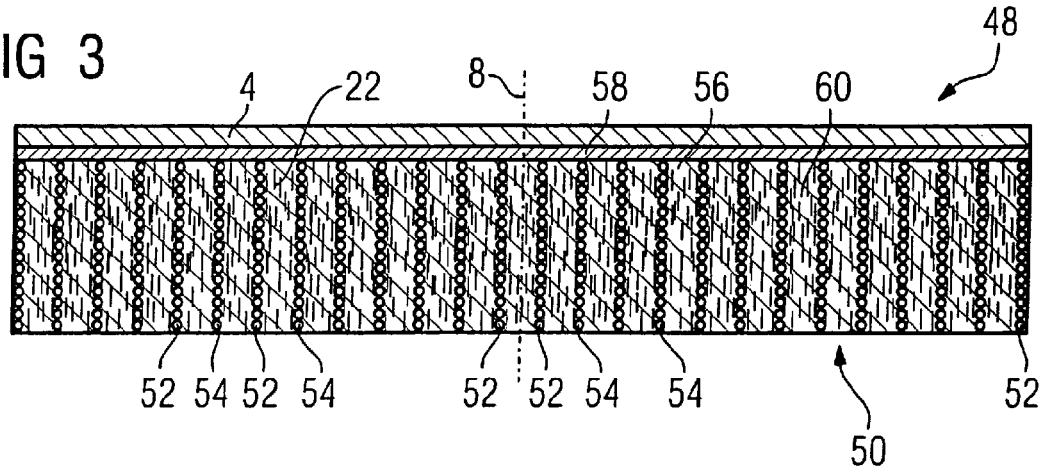
FIG. 3 shows a further x-ray anode with another carrier.

FIG. 3 shows an alternative x-ray anode 48 with an emission layer 4 on a carrier 50 whose carrier material comprises carbon fiber material 56 with three directed portions 22, 52, 54. The subsequent specification is essentially limited to the differences with regard to the exemplary embodiment in FIGS. 1 and 2 to which reference is made with regard to constant features and functions. Essentially constant components are in principle numbered with the same reference characters. The carbon fiber material 56 includes carbon fibers of the portion 22 that are executed and aligned just like the carbon fibers of the portion 22 in FIG. 1. The portions 52, 54 of the carbon fiber material 56 are aligned analogous to the portions 28, 30 and are respectively held together in a tissue or mesh mat made from carbon fiber material 56 that is wound in spirals around the rotation axis 8. The carbon fibers of the portion 52 are those of the type 1 and the carbon fibers of the portion 54 are those of the type 2.

To produce the x-ray anode 48, the emission layer 4 is provided with a metallic layer 58 that acts as a solder given a casting of metal 60 that should saturate the carbon fiber material 56. The carbon fiber material 56 made from two mats wound expanding in the radial direction is applied on this layer 58 with, if applicable, a preliminary auxiliary housing. The mats respectively comprise a layer made from carbon fibers of the portion 22 aligned in the axial direction in the carrier 50, which carbon fibers are aligned with a helical angle $\alpha_1$, $\alpha_2$ of respectively 19° relative to the tangential direction 34. Given a rolling of both mats, a repeating layer series of four layers results, namely a layer with portion 22, a layer with helically-arranged carbon fibers of the portion 52, again a layer with portion 22 and a layer with carbon fibers of the portion 54 arranged helically in the opposite direction, such that the carbon fibers of the portions 52, 54 form a mesh in helical form running in opposite directions. The carbon fibers can be coated with a carbide or metal and are subsequently saturated with the metal 60 as described with regard to FIG. 1. The carbon fiber material 56 is bonded with the emission layer 4 via the at least partial melting of the layer 58. Homogeneous material properties that promote a durable high stability of the carrier 50 result via the regular order of the layers made from carbon fibers of the type 1 and the type 2.

Although modifications and changes may be suggested by those skilled in the art, it is the intention of the inventor to embody within the patent warranted hereon all changes and modifications as reasonably and properly come within the scope of his contribution to the art.

We claim as our invention:

1. An x-ray anode comprising:

an emission layer;

a carrier layer comprised of carrier material on which emission layer is supported; and said carrier material comprising metallized carbon fiber material with at least a portion of fibers therein being oriented in a specified direction; and said carrier material being located in said carrier layer in a first metallized carbon fiber-containing layer situated next to said emission layer, and in a second metallized carbon fiber-containing layer spaced from said emission layer, said first carbon fiber-containing layer comprising a lower carbon fiber proportion than said second carbon fiber-containing layer.

2. An x-ray anode as claimed in claim 1 wherein said fibers in said metallized carbon fiber material are oriented in a direction toward said emission layer.

3. An x-ray anode as claimed in claim 1 wherein said metallized carbon fiber material comprises carbon fibers saturated with metal.

4. An x-ray anode as claimed in claim 1 wherein said metallized carbon fiber material comprises at least a first carbon fiber type and a second carbon fiber type differing from said first carbon fiber type.

5. An x-ray anode as claimed in claim 4 wherein said first carbon fiber type has a higher heat conductivity than said second carbon fiber type, and wherein said second carbon fiber type has at least one of a higher mechanical flexibility and a lower brittleness than said first carbon fiber type.

6. An x-ray anode as claimed in claim 4 wherein the fibers of said first carbon fiber type are oriented in a first specified direction and wherein the fibers of said second carbon fiber type are oriented in a second specified direction differing from said first specified direction.

7. An x-ray anode as claimed in claim 1 wherein said x-ray anode is rotatable around a rotation axis, and wherein said portion of said metallized carbon fiber material having said fibers oriented in said specified direction forms a helical track around said rotation axis.

8. An x-ray anode as claimed in claim 1 wherein said carrier material is cast on said emission layer.

9. An x-ray anode as claimed in claim 8 wherein said metallized carbon fiber material comprises solder that bonds said carrier material with said emission layer.

10. An x-ray anode as claimed in claim 9 wherein said metallized carbon fiber material comprises a metal that chemically interacts with said carbon and said solder.

11. An x-ray anode as claimed in claim 1 wherein said carrier material has a coefficient of expansion adapted to a coefficient of expansion of said emission layer in a radial direction of said x-ray anode.

* * * * *